US007180532B2

(12) United States Patent
Slattery et al.

(10) Patent No.: US 7,180,532 B2
(45) Date of Patent: Feb. 20, 2007

(54) DRY INK CONCENTRATION MONITOR INTERFACE WITH AUTOMATED TEMPERATURE COMPENSATION ALGORITHM

(75) Inventors: Scott T. Slattery, Brockport, NY (US); Kenneth M. Patterson, Rochester, NY (US); Kenneth P. Friedrich, Honeoye, NY (US)

(73) Assignee: Eastman Kodak Company, Rochester, NY (US)

( * ) Notice: Subject to any disclaimer, the term of this patent is extended or adjusted under 35 U.S.C. 154(b) by 181 days.

(21) Appl. No.: 11/022,209

(22) Filed: Dec. 21, 2004

(65) Prior Publication Data

US 2005/0134669 A1 Jun. 23, 2005

Related U.S. Application Data

(60) Provisional application No. 60/531,919, filed on Dec. 23, 2003.

(51) Int. Cl.
*G03G 15/08* (2006.01)

(52) U.S. Cl. ..... 347/158; 399/61; 399/62; 399/58

(58) Field of Classification Search ..... 399/30, 399/49, 58–64; 347/158
See application file for complete search history.

(56) References Cited

U.S. PATENT DOCUMENTS 6,160,970 A 12/2000 Scheuer et al.
6,169,861 B1 1/2001 Hamby et al.
6,175,698 B1 1/2001 Scheuer et al.
6,647,219 B2 11/2003 Buettner

FOREIGN PATENT DOCUMENTS

JP 2003-263022 * 9/2003

OTHER PUBLICATIONS

Computer-generated translation of JP 2003-263022.*

* cited by examiner

*Primary Examiner*—Huan Tran
(74) *Attorney, Agent, or Firm*—Lawrence P. Kessler

(57) ABSTRACT

A system, method, and apparatus for adjusting dry ink concentration in a developing station (30) of a printer is disclosed. The adjustment is performed by calculating the thermal drift of a dry ink monitor (40) and applying the result as a compensating factor in calculations in a software algorithm. The dry ink monitor (40) has a sensing port (42) in contact with a dry ink concentration and is connected to a dry ink monitor interface board (10) that houses a temperature sensor (20). The monitor interface board (10) is positioned in proximity to the dry ink monitor (40) to enable the temperature sensor (20) to measure a temperature of the dry ink concentration. The software algorithm is used to adjust the dry ink concentration based on a slope coefficient calculated by the printer based on outputs from the dry ink monitor (40) and the dry ink monitor interface board (10).

27 Claims, 6 Drawing Sheets

DRY INK CONCENTRATION MONITOR INTERFACE WITH AUTOMATED TEMPERATURE COMPENSATION ALGORITHM

CROSS REFERENCE TO RELATED APPLICATION

Reference is made to and priority claimed from U.S. Provisional Application Ser. No. 60/531,919, filed Dec. 23, 2003, entitled DRY INK CONCENTRATION MONITOR INTERFACE WITH AUTOMATED TEMPERATURE COMPENSATION ALGORITHM.

FIELD OF THE INVENTION

The present invention generally relates to an imaging system, and more specifically, to a method and apparatus for directly compensating the concentration of dry ink in a printer based on the thermal drift of the dry ink monitor and/or thermal testing data.

BACKGROUND OF THE INVENTION

An electrophotographic printer utilizes a developer mixture to form images on media. The developer is made up of two parts, magnetic carrier, and toner (dry ink). In order to maintain a constant dry ink concentration, the voltage level of the dry ink monitor must be maintained as close to a target voltage level as possible. Machine software adjusts the dry ink concentration to increase or decrease the amount of dry ink in the developer mixture to reach the target voltage level. For instance, the dry ink concentration can be varied by a replenisher that adds dry ink to the developer station, thereby decreasing the voltage response of the dry ink monitor. However, the thermal drift coefficient of each individual sensor varies from sensor to sensor since the sensors are inherently sensitive to temperature changes and the dry ink concentration can vary considerably during operation depending on the temperature. Also, the dry ink concentration sensor typically may exhibit positive or negative thermal drift, which may change over the life of the sensor.

The prior art includes systems that apply corrections to the toner magnetic sensors based upon temperature, burn-in, and toner-age. For example, U.S. Pat. No. 6,175,698 identifies that temperature, burn-in, and toner-age of the toner particles in each developer structure can affect the amount of toner required to develop the latent image. The sensor of the '698 patent is used to obtain the toner concentration readings, but cannot directly measure the actual toner concentration. Thus, the readings are adjusted by combining the target toner concentration to provide a error signal that is input to control feedback dispensing of the toner. The feedback dispenser of the '698 patent processes the error signal and commands the developing station to request that a certain toner mass per unit time be dispensed to compensate or correct for variations in temperature, burn-in, or toner-age to attempt to maintain the proper toner concentration.

However, these and other known sensors are susceptible not only to temperature fluctuations while in service in the machine, but are also susceptible to thermal drift of the sensors themselves.

Thus, a method and apparatus is needed that can compensate for the thermal drift of the sensors.

SUMMARY OF THE INVENTION

The present invention provides a temperature sensing device that is located on or near the dry ink concentration sensor of a developing station in an electrophotographic printer. The temperature-sensing device is capable of detecting the temperature of the dry ink monitor to adjust the dry ink concentration using the sign and magnitude of the temperature dependent thermal drift of the sensor as measured. The sign and magnitude of the temperature dependent thermal drift can then be used to correct the dry ink sensor output to the printer to compensate for the temperature variation.

The sensor is attached to an electronic, dry ink monitor interface board that is connected by a plug/connector wire to the dry ink monitor at one end and is connected by another plug/connector wire to the developer station. The temperature sensor can be a thermister, a thermal couple, or a solid state thermometer. Although the temperature sensor could be mounted to the dry ink/dry ink monitor, the temperature sensor is typically adjacent the dry ink monitor in an extrusion on the radiant side of the sump of the developer station. The temperature sensor is thus able to sense variations in the temperature of the dry ink monitor to determine the thermal drift of the dry ink monitor. The signal from the temperature sensor is be transmitted to a processing unit in the printer and the data is used in a software algorithm to vary the dry ink concentration based upon the temperature and thermal drift of the sensors.

The invention described herein is used to correct the dry ink sensor output to the printer to compensate for temperature variation in the sensor itself. The dry ink concentration sensor thermal drift is typically calibrated during initial power up of the machine when the dry ink station is running, but not imaging. This timing will report a constant dry ink concentration signal representative of real running conditions since the dry ink concentration would be constant at that point. This compensation can be accomplished through either hardware or software.

The invention also includes a software algorithm that allows for compensation of the thermal drift of the dry ink monitor measured by the temperature sensor of the dry ink monitor interface board.

The thermal drift of the dry ink monitor can be measured in two ways. First, the dry ink monitor itself can be individually and independently screened for thermal drift performance before it is installed in a printer. Second, the dry ink monitor can be used in the printer without screening and the thermal drift can be calculated by the software algorithm and used thereafter by the machine.

Independent and individual screening can be accomplished by heating the dry ink monitor or sensor in an oven. For example, the monitors could be heated in an oven from 25° C. to about 40° C. for one half hour. The monitors would then be allowed to cool. During this heat cycle the thermal drift of each monitor is measured as a change in the dry ink monitor voltage output versus the change in temperature. If an individual monitor does not meet the specified requirements for thermal drift, the monitor is not used in a printer.

The present invention however will allow the thermal drift measurement of the monitor to be matched with that specific monitor. The measured thermal drift can then be placed on a label on the monitor and can be used as a set point when the monitor is installed in the printer. The set point will allow the software algorithm described herein to apply the thermal drift of the monitor to calculations involving dry ink concentration by the dry ink monitor. This procedure will allow a monitor that would conventionally be unusable because of an undesirable thermal drift to be used in the printer with the thermal drift of the individual monitor taken into account by the software algorithm during adjustment of the dry ink concentration.

The label included on the monitor could list any additional data, including volts per degree or other pertinent information from the testing, but the thermal drift measurement should be included regardless. The monitors of the present invention typically have a zero to five volt output. The monitors are then centered or normalized to two and one-half volts. Thus, the thermal drift change measured herein is a deviation, plus or minus, from two and one-half volts. This normalization could be performed at any desired point in the available voltage with two and one-half volts being an example of a typical monitor.

A second way to compensate for the thermal drift of the dry ink monitor is to place the dry ink monitor into the printer, sample the temperature of the thermal sensor on the dry ink monitor interface board, and use the sampled thermal drift of the monitor in calculations in a software algorithm. Although the monitors of the first way of compensation require heating and testing the components to be used in the printer, the monitors in this second way of compensation can be placed into use in the printer without heating or testing the electronics.

Further, even if the monitors were evaluated upfront for individual thermal drift, the algorithm described herein could be used. This procedure will allow any monitors to be used, including ones already installed in existing machines with the software algorithm updated to compensate for the thermal drift of the monitor.

The software routine typically begins at machine power up when the machine subsystem components run through diagnostics and warming the fuser to the required operating temperature. While the machine software is initializing, the developer station is run for a brief period to read the temperature sensor on the dry ink monitor interface board and the output signal from the dry ink monitor.

While the machine continues to warm the fusing system, other key subsystems are initialized. After the initializations are complete and with the developer station running, the temperature sensor on the dry ink monitor interface board and the dry ink monitor output signal are again read. The slope of the temperatures measured versus the dry ink monitor output signal drift is then calculated. This calculation involves dividing the change in the monitor output by the change in the temperature output at the two points measured. Thus, the initial measurements or set points are evaluated against the temperature and output signal measured when the system has warmed to its operating temperature to calculate the thermal drift as a compensation factor. The thermal drift calculations are dependent only upon an existence of a change in the measured temperatures. This change will be found since the machine proceeds from a cold start to a warm, operational phase.

The software routine then applies the dry ink monitor drift slope coefficient to the calculations involving dry ink concentration algorithms. The printer can then compensate for the thermal drift by adjusting the dry ink concentration mixture to increase or decrease the dry ink component as determined by the software. Further, if the sensor has been in use for a period of time in a printer, the thermal drift for the installed sensor could vary over the life of the part. The software algorithm described herein will enable re-testing of the sensor to adjust the thermal drift set point as necessary to enable longer life out of each sensor.

Thus, the present invention provides a computer readable medium containing a computer program product with instructions for controlling a dry ink concentration in a development station in a printer. The computer program includes program instructions for receiving and decoding a start-up monitor output from a dry ink monitor, program instructions for receiving and decoding a start-up temperature from a dry ink monitor interface board, and program instructions for adjusting the dry ink concentration to achieve a preferred dry ink concentration. Before the computer program receives and decodes the start-up monitor output, the computer program product can receive and decode a start-up monitor output. In such a situation, the computer readable medium includes program instructions for receiving and decoding a start-up dry ink monitor output of the dry ink concentration with the dry ink monitor and program instructions for receiving and decoding a start-up temperature of the dry ink monitor with the dry ink monitor interface board. Further, before the program instructions for receiving and decoding a start-up monitor output, the computer readable medium can include program instructions for calculating a measured temperature change by finding a temperature difference between the start-up temperature and the operating temperature, program instructions for calculating a measured monitor output change by finding a monitor output difference between the start-up monitor output and the operating monitor output, and program instructions for calculating a thermal drift coefficient by dividing the measured monitor output change by the measured temperature change.

The present invention also includes a system for adjusting for thermal drift that includes a dry ink monitor with a sensing port in contact with a dry ink concentration and a monitor interface board with a temperature sensor. The monitor interface board is positioned in proximity to the dry ink monitor to enable the temperature sensor to measure a temperature of the dry ink monitor. Typically, the temperature sensor senses a start-up temperature at the start up of the printer, which is transmitted to a central processing unit of the printer. The temperature sensor next senses an operating temperature of the dry ink concentration that is transmitted to the central processing unit.

The system also senses a start-up monitor output at start up of the printer, which is also transmitted to a central processing unit of the printer. The system next senses an operating monitor output of the dry ink monitor and transmits such to the central processing unit. The central processing unit compares the start-up monitor output to the operating monitor output and compares the start-up temperature to the operating temperature. The software algorithm then calculates the thermal drift of the dry ink monitor.

DETAILED DESCRIPTION OF THE INVENTION

Figure 1:
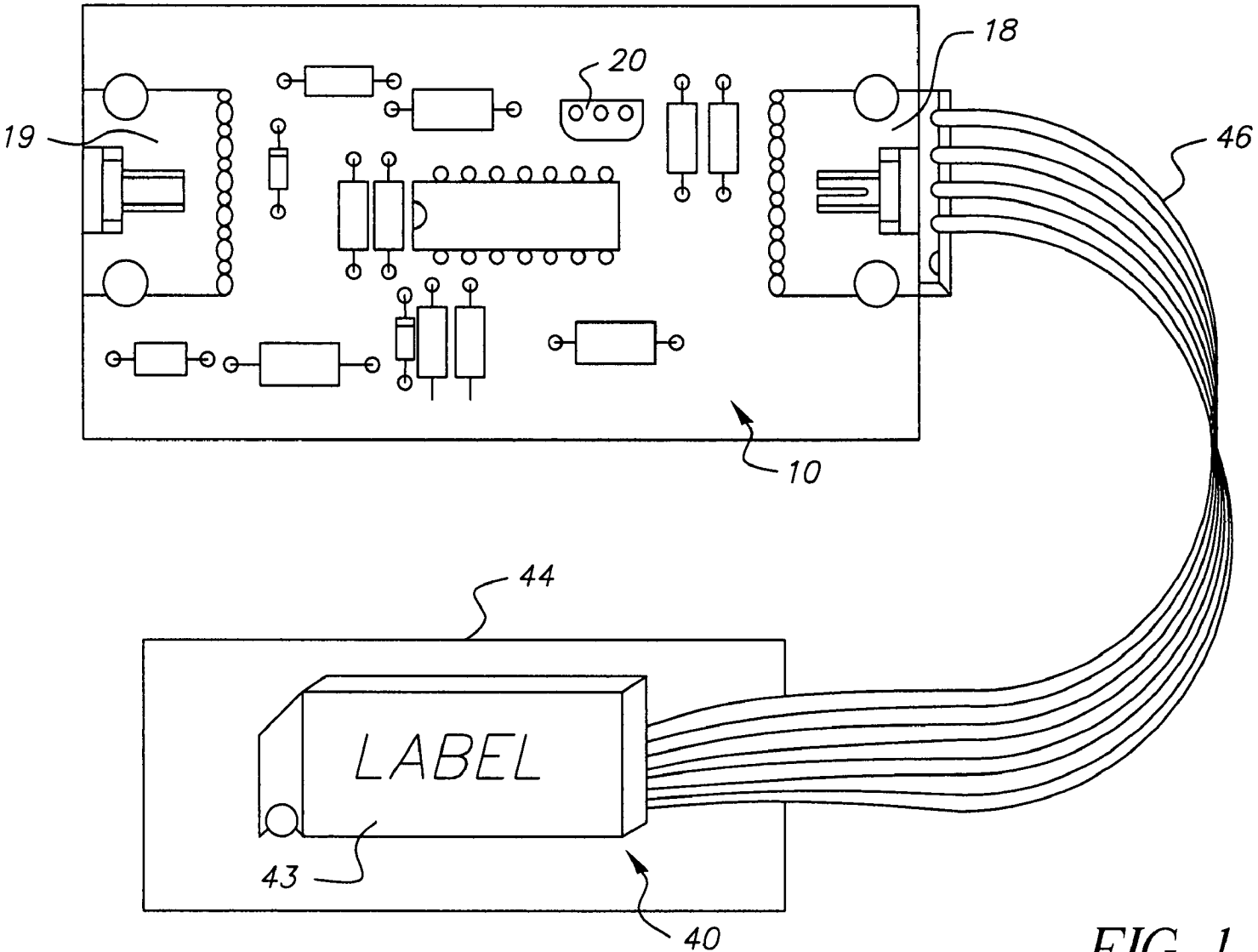
FIG. 1 shows a dry ink monitor interface board connected to a dry ink monitor and a mounting interface.

Reference is now made in more detail to the drawing figures, wherein like numerals refer, where appropriate, to like parts throughout. FIG. 1 shows a dry ink monitor interface board 10 connected to a dry ink monitor 40 and a mounting interface 44. The dry ink monitor interface board 10 has a temperature sensor 20 mounted thereupon. The dry ink monitor interface board 10 is generally formed of typical circuit board materials and is capable of receiving a number of components thereupon. The dry ink monitor interface board 10 can include capacitors, resistors, op amps, electrical connectors, at least one temperature sensor 20, and other electrical components such as Zener diodes. The capacitors, resistors, op amps, electrical connectors, and other electrical components are typical circuitry components that function as like components known in the art. The electrical connectors are capable of receiving connector wires.

As also shown in FIG. 1, connector wire 46 is typically attached at one end to the dry ink monitor 40 with the other end received by electrical connector 18. Electrical connector 18 is typically a five (5)-pin connector to match the connector wire 46. Electrical connector 19 is typically a six (6)-pin connector and is capable of receiving a six-pin connector wire (not shown), which is plugged into the developer station's harness (not shown). In this preferred embodiment, the electrical connectors 18 and 19 are formed with five (5) pins and six (6) pins, respectively, in order to ensure that the respective connector wires are received in the proper junction. One of ordinary skill will recognize that the 5- and 6-pin connector arrangements are merely preferred in this embodiment and could easily be comprised of any combination of pin connectors, including equal numbered pins for each connector. The invention should thus not be limited to the pin arrangement disclosed.

Accordingly, two signals exit the dry ink monitor interface board: the voltage monitor output that is sent to the machine and the temperature output that is sent to the machine through a connector wire (not shown) connected to connector 19 and coupled to the developer station harness (not shown). The outputs are then received into the computer logic boards of the machine. The software then proceeds with the algorithm as detailed in the flowchart of FIG. 5.

The dry ink monitor interface board 10 is typically shrink-wrapped to eliminate the possibility of grounding out the board once the components are attached thereto. The electrical connectors or plugs 18 and 19 as attached by the connector wires allow the dry ink monitor interface board 10 to be contained in a lower extrusion of the developer station and can even hang below the dry ink monitor 40 in the development station 30. The board 10 could also be clipped to a protrusion in the development station 30. Regardless of desired placement, the board 10 is placed as close as possible to the dry ink monitor 40 to allow the temperature sensor 20 to sense the temperature of the dry ink monitor 40.

Figure 2:
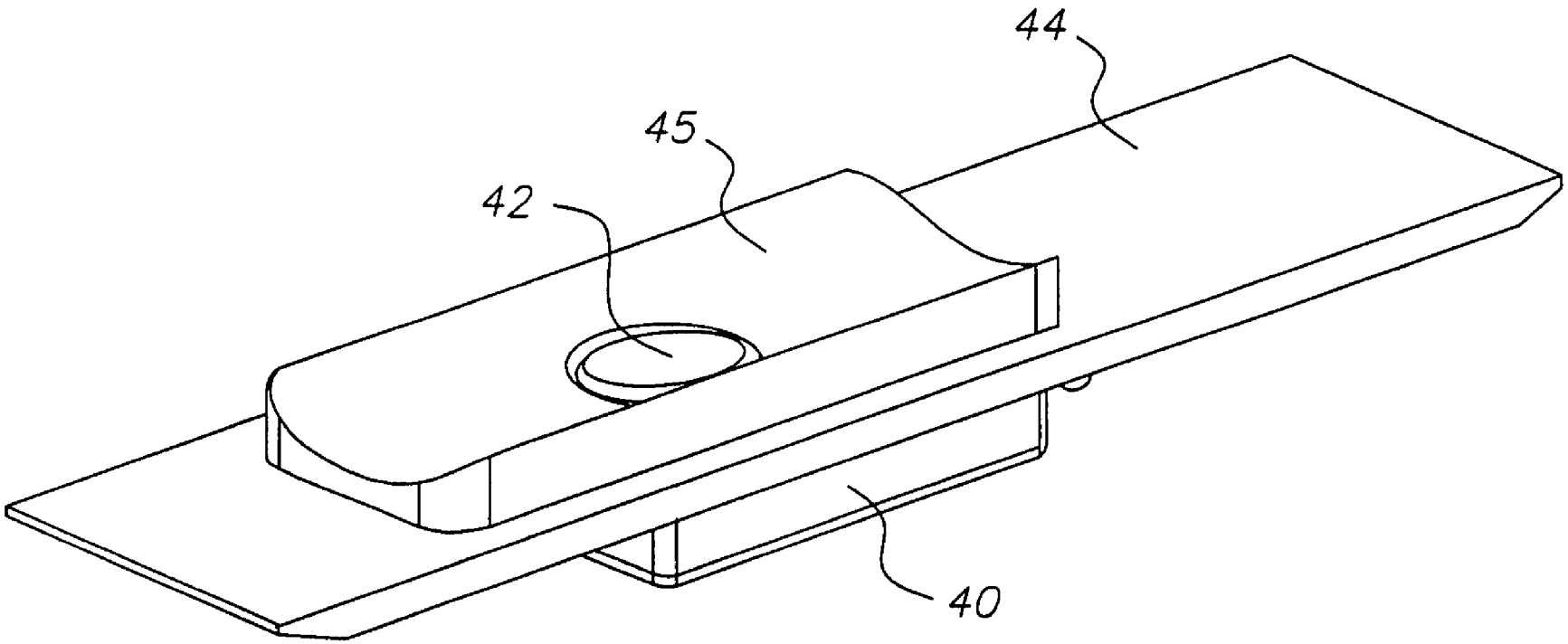
FIGS. 2 and 3 show isometric and side views of the dry ink monitor on the mounting interface.
Figure 3:
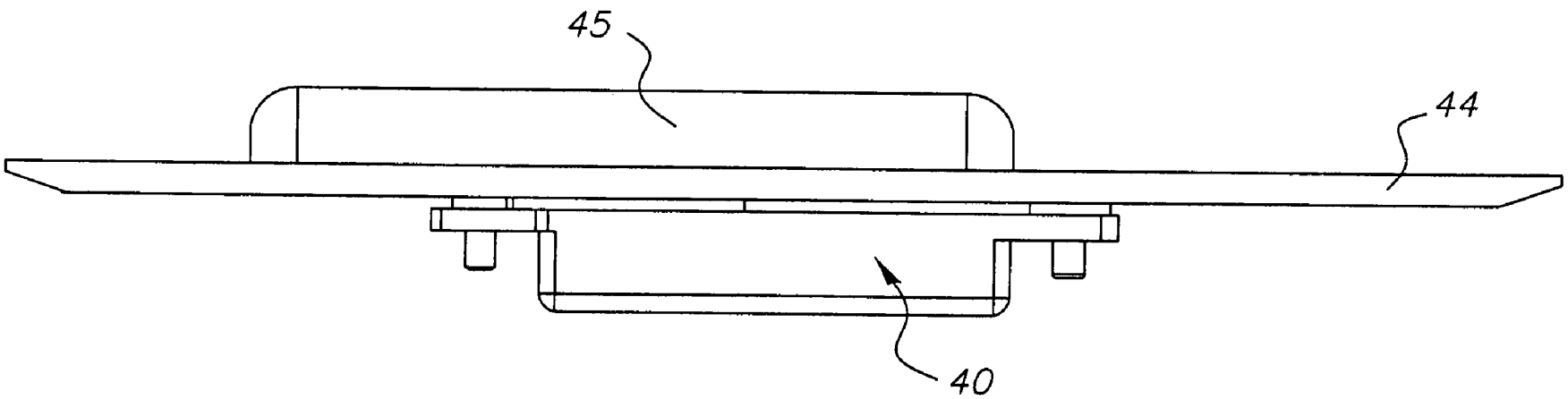
Figure 4:
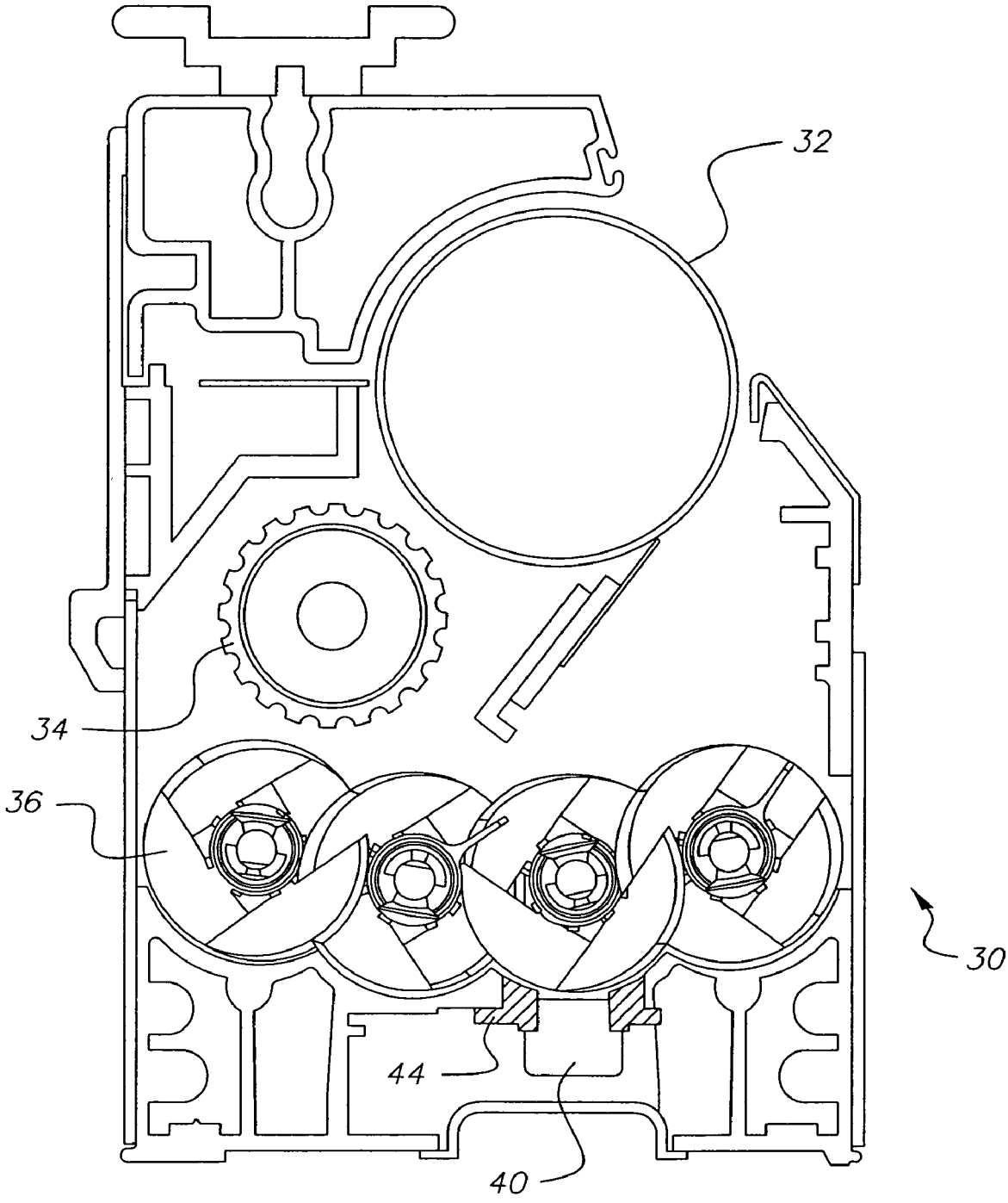
FIG. 4 shows a development station housing the dry ink monitor and mounting interface.

FIGS. 2 and 3 show isometric and side views of the dry ink monitor 40 mounted onto the mounting interface 44. The mounting interface 44 is typically a plastic mounting 44 that receives the dry ink monitor 40 on the underside thereof. Although it could be formed of other materials, the mounting interface 44 is typically formed of plastic to reduce the interference with the monitor or other sensing equipment. The plastic mounting 44 merely acts as an interface for the monitor to the developer station 30. The plastic mounting 44 typically will include a portion 45 on the upper surface, shown in FIG. 2 as a rounded or concave section, that will mount into the developing station 30 below the mixing augers 36 as shown in FIG. 4 and match the rounded profile thereof. The raised portion 45 of the plastic mounting 44 also includes a dry ink monitor port 42 in contact with the magnetic dry ink concentration in the development station 30 to sense the dry ink concentration's characteristics. As shown in FIG. 1, a label 43 can be affixed to the dry ink monitor 40 to identify the thermal drift coefficient as measured of the monitor 40.

The dry ink monitor 40 can be attached to the plastic mounting 44 by snap-in connectors, screw threading, or any other connection means that will allow the dry ink monitor 40 to remain securely attached to the plastic mounting 44. The connector wire 46, which is coupled to the dry ink monitor interface board 10 at electrical connector 18 as described above, will typically extend from the dry ink monitor 40 and is attached therein. The connector wire 46 however could be received by an electrical connection (not shown) coupled to, or integral with, the dry ink monitor 40.

FIG. 4 shows a development station 30 that can be housed in an electrophotographic printer. The development station 30 includes a development roller 32, a transport roller 34, and mixing augers 36. The development roller 32 will typically be in contact with an image roller to engage the charged dry ink particles onto the print media that receives the desired image (not shown). The mixing augers 36 are used to combine the dry ink with the magnetic carrier particles to achieve an even mixture. The development station 30 also houses the dry ink monitor 40 and mounting interface 44 in a lower extrusion. The concave portion 45 of the plastic mounting 44 matches the curved profile of the mixing auger 36 under which the dry ink monitor 40 is disposed. The port 42 of the dry ink monitor 40 is in contact with the dry ink concentration, which is being mixed by the mixing augers 36, in the cavity of the development station 30. The dry ink monitor interface board 10 is disposed (not shown) in an air cavity beneath the dry ink monitor 40 and is connected thereto by connector wire 46 as described above. The snap-in, C-cross-sectional floor/closure beneath the dry ink monitor 40 forms the lower wall of the cavity housing the dry ink monitor interface board 10.

The invention described herein can be used in development stations in an electrophotographic machine, such as the NexPress 2100. Each developer station will include a dry ink monitor interface board. The printer could include as many development stations as desired with a dry ink monitor interface board and dry ink monitor for each.

Figure 5:
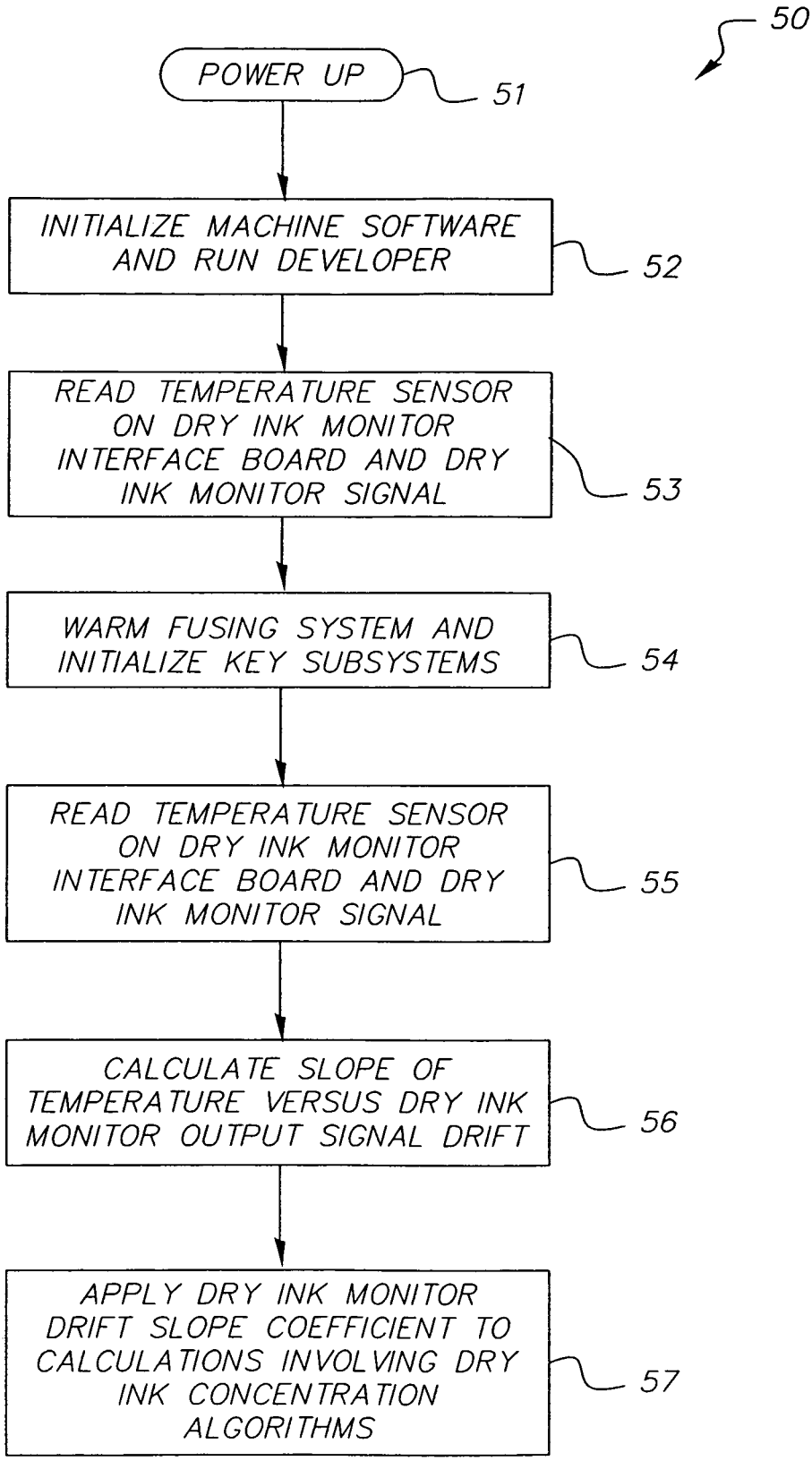
FIG. 5 is a flowchart for the dry ink monitor thermal compensation operation.

FIG. 5 is a flowchart of the software algorithm/compensation routine 50 of the measurement of the dry ink monitor thermal drift. The routine 50 begins at step 51 with power up of the machine. The routine 50 continues to step 52 where the machine software is initialized and the developer station is run. At step 53, readings are taken from the temperature sensor 20 on the dry ink monitor interface board 10 and the dry ink monitor 40. The routine 50 proceeds to block 54 with the machine continuing to warm the fusing system and initializing key subsystems.

After the initialization is complete, the routine 50 proceeds to step 55 where the temperature sensor on the dry ink monitor interface board 10 and the dry ink monitor 40 output signal are read. In step 56, the slope of the measured temperature change versus the dry ink monitor output signal drift is calculated. The slope coefficient of the dry ink monitor drift is then applied in step 57 to calculations involving dry ink concentration algorithms. Step 57 uses the software to calculate the amount of replenishment needed to maintain a constant dry ink concentration. The dry ink monitor drift slope coefficient as calculated is then used as a multiplier. The dry ink monitor reading is multiplied by the coefficient to compensate for the temperature or thermal drift.

Another manner of compensating for the thermal drift is to perform a service routine to conduct a thermal drift test. Such a routine could be operated by service personnel after the monitors have been installed in the printer. This service routine would require the dry ink station to run for a period of time while disengaged from the photoconductive element.

The sensors/monitor used herein typically operate to detect any temperature drift or change from the initialized/desired dry ink concentration percentage. Thus, a desired temperature of 25° C. for example would register any positive or negative deviation from 25° C. The monitor readings are typically taken about twice per frame or about once every 360 milliseconds. The thermal slope coefficient is then applied to the dry ink monitor voltage in the calculation every time it is read.

Figure 6:
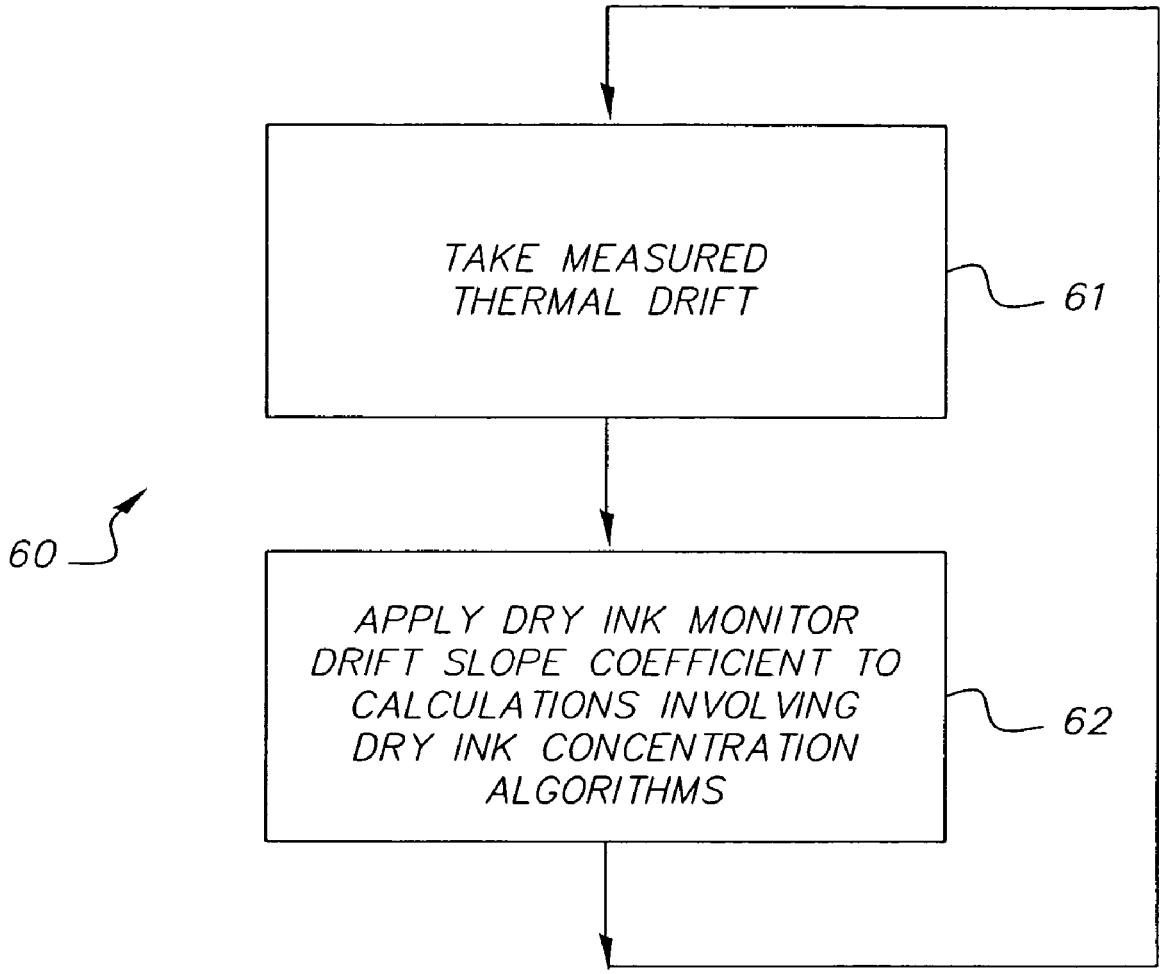
FIG. 6 is a flowchart of a normally running process loop.

FIG. 6 is a flowchart of a normally running process loop. The process 60 begins at step 61 by retrieving the measured thermal drift, which has been calculated through either routine 50 of FIG. 5, heating and cooling to establish a set point, or a service routine performed subsequent to routine 50 of FIG. 5. The service routine would involve the same procedural steps as routine 50. The process 60 continues to step 62 where the dry ink monitor drift slope coefficient is applied to calculations involving dry ink concentration algorithms. The process loops back to step 61 after a predetermined time has elapsed. This time is currently performed once every 360 milliseconds, but could be adjusted as desired.

While the invention has been particularly shown and described with reference to a preferred embodiment thereof, it will be understood by those skilled in the art that various other changes in form and detail may be made without departing from the spirit and scope of the invention as set forth in the claims.

What is claimed is:

1. A system for adjusting for thermal drift comprising:

a dry ink monitor with a sensing port in contact with a dry ink concentration;

a monitor interface board with a temperature sensor; and wherein the monitor interface board is positioned in proximity to the dry ink monitor to enable the temperature sensor to measure a temperature of the dry ink monitor.

2. The system of claim 1 wherein the monitor interface board and dry ink monitor are in a development station of an electrophotographic printer.

3. The system of claim 2 wherein, the temperature sensor senses a start-up temperature at the start up of the printer.

4. The system of claim 3 wherein the start-up temperature of the dry ink concentration is transmitted to a central processing unit of the printer.

5. The system of claim 4 wherein the temperature sensor senses an operating temperature of the dry ink concentration that is transmitted to the central processing unit.

6. The system of claim 5 wherein the central processing unit compares the start-up temperature to the operating temperature and calculates a temperature change.

7. The system of claim 2 wherein the dry ink monitor senses a start-up monitor output at start up of the printer.

8. The system of claim 7 wherein the start-up monitor output is transmitted to a central processing unit of the printer.

9. The system of claim 8 wherein the dry ink monitor senses an operating monitor output that is transmitted to the central processing unit.

10. The system of claim 9 wherein the central processing unit compares the start-up monitor output to the operating monitor output.

11. The system of claim 1 wherein the dry ink concentration includes a dry ink component and a magnetic component.

12. The system of claim 11 wherein the dry ink monitor senses the magnetic component of the dry ink concentration.

13. The system of claim 1 wherein the dry ink monitor is tested before being installed into the printer to determine a thermal drift.

14. The system of claim 13 wherein the dry ink monitor is heated to measure the thermal drift.

15. The system of claim 14 wherein the thermal drift is printed on a label on the dry ink monitor to be used as a set point when the dry ink monitor is installed into the printer.

16. A method of adjusting dry ink concentration of a printer that includes a dry ink monitor and a dry ink monitor interface board, the method comprising:

sampling an operating dry ink monitor output of dry ink concentration with the dry ink monitor;

sampling an operating temperature adjacent the dry ink monitor with the dry ink monitor interface board; and adjusting the dry ink concentration, taking into account the sampled operating temperature, to achieve a preferred dry ink concentration.

17. The method of claim 16 wherein before sampling the operating monitor output, the method includes:

sampling a start-up dry ink monitor output of the dry ink concentration with the dry ink monitor; and sampling a start-up temperature of the dry ink monitor with the dry ink monitor interface board.

18. The method of claim 17 wherein the start-up temperature and the operating temperature are different.

19. The method of claim 18 wherein before adjusting the dry ink concentration, the method comprises:

calculating a measured temperature change by finding a temperature difference between the start-up temperature and the operating temperature;

calculating a measured monitor output change by finding a monitor output difference between the start-up monitor output and the operating monitor output; and calculating a thermal drift coefficient by dividing the measured monitor output change by the measured temperature change.

20. The method of claim 19 wherein the calculating steps are each performed by a computer readable medium.

21. The method of claim 16 wherein the dry ink concentration includes a dry ink component and a magnetic component and wherein adjusting the dry ink concentration involves:

changing an amount of the dry ink component in the dry ink concentration.

22. The method of claim 16 wherein before adjusting the dry ink concentration, the method includes:

determining a thermal drift in the dry ink monitor.

23. The method of claim 22 wherein the determining the thermal drift is accomplished by a software algorithm.

24. A computer readable medium containing a computer program product comprising instructions for controlling a dry ink concentration in a development station in a printer, the computer program product comprising:

program instructions for receiving and decoding a start-up monitor output from a dry ink monitor;

program instructions for receiving and decoding a start-up temperature from a dry ink monitor interface board; and program instructions for adjusting the dry ink concentration, taking into account the start-up temperature, to achieve a preferred dry ink concentration.

25. The computer readable medium for controlling the dry ink concentration of claim 24 wherein before the program instructions for receiving and decoding a start-up monitor output, the computer program product includes:

program instructions for receiving and decoding a start-up dry ink monitor output of the dry ink concentration with the dry ink monitor; and program instructions for receiving and decoding a start-up temperature of the dry ink monitor with the dry ink monitor interface board.

26. The computer readable medium for controlling the dry ink concentration of claim 25 wherein the start-up temperature and the operating temperature are different.

27. The computer readable medium for controlling the dry ink concentration of claim 26 wherein before the program instructions for receiving and decoding a start-up monitor output, the computer program product includes:

program instructions for calculating a measured temperature change by finding a temperature difference between the start-up temperature and the operating temperature;

program instructions for calculating a measured monitor output change by finding a monitor output difference between the start-up monitor output and the operating monitor output; and program instructions for calculating a thermal drift coefficient by dividing the measured monitor output change by the measured temperature change.

* * * * *